US007387762B2

(12) United States Patent
Hirasawa et al.

(10) Patent No.: US 7,387,762 B2
(45) Date of Patent: Jun. 17, 2008

(54) APPARATUS FOR SINTERING SILVER CLAY

(75) Inventors: Juichi Hirasawa, Sanda (JP); Yasuo Ido, Kobe (JP)

(73) Assignee: Mitsubishi Materials Corporation, Chiyoda-Ku, Tokyo (JP)

( * ) Notice: Subject to any disclaimer, the term of this patent is extended or adjusted under 35 U.S.C. 154(b) by 17 days.

(21) Appl. No.: 10/250,869

(22) PCT Filed: Jul. 11, 2002

(86) PCT No.: PCT/JP02/07049

§ 371 (c)(1),
(2), (4) Date: Jun. 30, 2003

(87) PCT Pub. No.: WO03/008132

PCT Pub. Date: Jan. 30, 2003

(65) Prior Publication Data

US 2004/0042923 A1 Mar. 4, 2004

(30) Foreign Application Priority Data

Jul. 17, 2001 (JP) ..... 2001-216321
May 29, 2002 (JP) ..... 2002-155605

(51) Int. Cl.
*C21D 1/00* (2006.01)
*B29C 33/02* (2006.01)

(52) U.S. Cl. ..... 266/261; 266/279; 432/120; 432/185; 264/642; 264/644; 264/679; 264/680; 264/80; 219/386; 219/390

(58) Field of Classification Search ..... 264/642, 264/644, 679, 680, 80; 419/36, 37, 38, 46, 419/56; 266/261, 279; 432/120, 185; 219/386, 219/390; 75/252, 255
See application file for complete search history.

(56) References Cited

U.S. PATENT DOCUMENTS

| | | | | |
|---|---|---|---|---|
| 1,222,571 | A | 4/1917 | Ball | |
| 1,247,806 | A | 11/1917 | Ferdon | |
| 1,277,149 | A | 8/1918 | Strobl | |
| 1,285,042 | A | 11/1918 | Clark | |
| 1,300,594 | A | 4/1919 | Ferdon | |
| 1,411,076 | A | 3/1922 | Ball | |
| 1,446,353 | A * | 2/1923 | Slocum | 431/341 |
| 1,487,651 | A * | 3/1924 | Fuller | 110/217 |

(Continued)

FOREIGN PATENT DOCUMENTS

CN 2070565 U 2/1991

(Continued)

OTHER PUBLICATIONS

English machine translation of JP 2001-151556 A, Japanese Patent Office Website, Jan. 2005.*

(Continued)

*Primary Examiner*—Christina Johnson
*Assistant Examiner*—Jeff Wollschlager
(74) *Attorney, Agent, or Firm*—Darby & Darby P.C.

(57) ABSTRACT

A sintering apparatus for silver clay wherein a silver clay composition can be readily and easily sintered by exposing a silver clay composition obtained by molding to a flame of a solid alcohol fuel.

9 Claims, 4 Drawing Sheets

U.S. PATENT DOCUMENTS

| | | | | | |
|---|---|---|---|---|---|
| 2,662,263 | A | * | 12/1953 | Fuger | 432/185 |
| 2,737,911 | A | * | 3/1956 | Mims | 110/217 |
| 3,786,162 | A | * | 1/1974 | Colson | 373/119 |
| 4,628,895 | A | * | 12/1986 | Santilli | 126/25 R |
| 4,905,659 | A | | 3/1990 | Armistead | |
| 4,971,597 | A | * | 11/1990 | Gartner | 44/267 |
| 5,315,922 | A | * | 5/1994 | Keller | 99/447 |
| 5,376,328 | A | * | 12/1994 | Hoshino et al. | 419/36 |
| 5,539,183 | A | * | 7/1996 | Beckley | 219/386 |
| 5,702,501 | A | | 12/1997 | Osawa et al. | |
| 6,290,744 | B1 | * | 9/2001 | Fujimaru et al. | 75/247 |
| 2004/0115583 | A1 | * | 6/2004 | Hohenshelt et al. | 432/156 |

FOREIGN PATENT DOCUMENTS

| | | | | |
|---|---|---|---|---|
| DE | 40 30 835 | A1 | | 4/1992 |
| EP | 1 027 945 | A | | 8/2000 |
| JP | 05-132702 | A | * | 5/1993 |
| JP | 9-227904 | A1 | | 9/1997 |
| JP | 10-226802 | A1 | | 8/1998 |
| JP | 2000-80404 | A1 | | 3/2000 |
| JP | 2001-151556 | A1 | | 6/2001 |
| JP | 2001-284039 | A1 | | 10/2001 |
| JP | 2003-194303 | A | * | 7/2003 |
| KR | 0003441 | | | 10/1970 |

OTHER PUBLICATIONS

English machine translation of JP 05-132702 A, Japanese Patent Office Website, Jan. 2005.*

English machine translation of JP 09-227904 A, Japanese Patent Office Website, Jan. 2005.*

English machine translation of JP 10-226802 A, Japanese Patent Office Website, Jan. 2005.*

English machine translation of JP 2000-080404 A, Japanese Patent Office Website, Jan. 2005.*

English machine translation of JP 2001-284039 A, Japanese Patent Office Website, Jan. 2005.*

English machine translation of JP 2003-194303 A, Japanese Patent Office Website, Jan. 2005.*

English Abstract of Chinese Utility Model Application, Publication No. CN 2070565U published on Feb. 6, 1991.

Supplementary Partial European Search Report for EP 02 74 5961 mailed May 6, 2005.

Supplementary European Search Report for EP 02 74 5961 completed Jul. 22, 2005.

Communication pursuant to Article 96(2) EPC dated Jul. 20, 2006 for corresponding EP application No. EP 02 745 961.9.

* cited by examiner

APPARATUS FOR SINTERING SILVER CLAY

The present application is a national stage of PCT/JP02/07049, filed Jul. 11, 2002 and claims the benefit of Japanese Patent Application No. 2001-216321, filed Jul. 17, 2001 and Japanese Patent Application No. 2002-155605, filed May 29, 2002.

BACKGROUND OF THE INVENTION

1. Field of the Invention

The present invention relates to a method and an apparatus for easily sintering a silver clay composition.

2. Description of the Related Art

In general, silver clay is obtained by mixing a powder of pure silver or silver alloy with binder and the like. An accessory is manufactured by heating and sintering a silver clay composition which is obtained by forming the silver clay to a predetermined shape and drying it in an electric furnace or a gas furnace whose heating temperature can be controlled.

While the above electric furnace or the gas furnace is relatively suited to sinter a lot of work pieces simultaneously since the furnace is relatively large, it is difficult for an individual worker to prepare this type of furnace. Accordingly, a sintering method in which the silver clay composition is inserted into a sintering box which absorbs microwave and generates heat, and is sintered by setting the sintering box in a household microwave oven has been proposed recently. However, this sintering method is inconvenient since the special sintering box which absorbs microwave and generates heat has to be prepared. Furthermore, since temperature control is difficult and the heating condition of the silver clay composition in the sintering box cannot easily be observed, occasionally the clayish composition melts due to excessive heat beyond a melting point thereof.

In addition, a sintering method for the silver clay in which the silver clay composition is sintered by being directly exposed to the flame of a gas burner has been proposed recently (see Japanese Patent Application, First Publication No. 2000-80404). In this method, the flame of the gas burner can be freely controlled and the silver clay composition can be sintered anywhere merely by preparing a portable gas bottle and a gas burner.

However, in the method in which the silver clay composition is sintered using the gas burner, the gas burner is generally used without a cover and thus the flame of the gas burner is visible whole the sintering operation. In this case, the flame of the gas burner often ignites explosively even though it can be controlled, and as a result, when a person uses the burner, the desire to manufacture an accessory by heating the silver clay may be dampened due to a fear of the gas burner. While a method in which the silver clay composition is heated and sintered by the flame of the gas burner in a receptacle that is made of a fireproof material has been proposed, however, in the case of performing the sintering in the receptacle, the operability is decreased unless the space in the receptacle is enlarged so that the gas burner can be moved within the receptacle. As a result, the receptacle becomes larger, and therefore, labor for installing the receptacle and a space for storing the receptacle after the sintering operation are necessary.

Furthermore, though the gas burner is convenient in that the flame thereof can be freely controlled, it is difficult to adjust the temperature of the flame to the optimum temperature for the sintering of the silver clay composition. Therefore, the temperature of the flame often deviates from the optimum temperature for the sintering of the silver clay composition as a result of controlling of the flame. Consequently, it is difficult to obtain desired accessories.

SUMMARY OF THE INVENTION

The inventors of the present invention have carried out investigations to develop a method for readily and easily sintering the silver clay, and learned the following.

(a) The flame of a solid alcoholic fuel is the best for sintering the silver clay composition. Therefore, the silver clay composition can easily be sintered by using the flame of the solid alcoholic fuel as a heat source for sintering the silver clay composition and directly exposing the silver clay composition to the flame of the solid alcoholic fuel.

(b) The solid alcoholic fuel can easily be handled since a lamp having a candlewick for using the liquid alcoholic fuel is unnecessary. Furthermore, since an area of a disc shaped burning part can be enlarged, a flame which sufficiently covers the silver clay composition can be formed by enlarging the area of the burning part which produces the flame.

The present invention is achieved based on the above knowledge, and provides:

(1) a sintering method for the silver clay for heating and sintering the silver clay composition by the flame of the solid alcoholic fuel, and (2) a sintering method for the silver clay for heating and sintering the silver clay composition by placing the silver clay composition on a screen and exposing the silver clay composition to the flame of the solid alcoholic fuel.

The solid alcoholic fuel is usually formed into a disc shape or a conical shape that has upper and lower planes with a relatively large area. Therefore, the relatively large and gentle flame is produced by igniting this relatively enlarged upper plane, and the silver clay composition can be sintered while the composition is surrounded by this relatively large and gentle flame.

However, since the flame of the solid alcoholic fuel has the defect that the flame may caused to flicker greatly due to a light breeze, it is preferable that the solid alcoholic fuel is burned in a sintering space which is surrounded by a heat insulating material in order to prevent the flicker of the flame of the solid alcohol fuel by the light breeze.

Hence, the present invention also provides:

(3) a sintering method for the silver clay according to the above (1) or (2), and the sintering is performed by exposing the silver clay composition to the flame of the solid alcoholic fuel while they are surrounded by a wall member which is made of the heat insulating material.

When placing the solid alcoholic fuel in the sintering space which is surrounded by the wall member and igniting it, the temperature in the sintering space reaches 700° C. or higher in a relatively short time, however, the temperature does not exceed 830° C. As a result, the temperature of the sintering space is maintained between 700 and 800° C. while the solid alcoholic fuel is burning. Since this temperature between 700 and 800° C. is an optimum temperature range for the sintering of the silver clay composition, it is unnecessary to implement a special handling for temperature control when the silver clay composition is sintered using the solid alcoholic fuel.

Furthermore, the present inventors were able to implement readily and simply a sintering method for a silver clay disclosed in the above (1) and (2), and additionally carried out investigations to develop an apparatus that has as narrow the sintering space as possible and is thus easily stored. As a result, the following was found.

(c) When an apparatus having an air hole in at least a side wall thereof and the solid alcohol fuel necessary for one sintering are prepared, and spreading the flame produced by the burning of the solid alcohol fuel placed in the apparatus over a wide range and completing the burning simultaneously with that of the sintering of the silver clay composition; it is possible to sinter the silver clay in a narrow sintering space. Thus, it is unnecessary to maintain a space to move the gas burner such as the case of sintering which is performed by the gas burner.

(d) In the apparatus having this narrow sintering space, it is preferable that the sintering apparatus is composed of a plurality of parts in order that a lid is in place and thus it is difficult to view from the outside during the sintering of the silver clay composition, and the lid is opened and the sintered body is removed after the sintering has completed. Furthermore, it is preferable that the sintering apparatus is assembled from the parts when the sintering apparatus is used, and after the completion of the sintering of the silver clay composition, the sintering apparatus is disassembled and stored.

(e) More preferably, in order to remove the sintered body by opening the lid immediately after the completion of the sintering, a handle part that is not heated by the sintering is provided on the lid.

Based on this knowledge, the present invention provides:

(4) a silver clay sintering apparatus comprises a burning cylinder with a bottom that has air holes in at least a side wall thereof, a burning lid part that covers an upper part of this burning cylinder with a bottom and has a lower end opening part that engages an upper end opening part of the burning cylinder with a bottom; wherein a screen can be engaged on the upper end opening of the burning cylinder with a bottom, and a roof having an exhaust hole in the ceiling thereof is provided on the burning lid part that has the lower edge opening part, (5) a silver clay sintering apparatus that provides a burning cylinder with a bottom providing air holes in at least the side wall and a burning lid part that covers the upper part of this burning cylinder with a bottom and has a lower end opening part that engages an upper end opening part of the burning cylinder with a bottom, wherein a screen can be engaged on the upper end opening of the burning cylinder with a bottom, and furthermore, a roof having an exhaust hole in the ceiling thereof and a cylinder handle are provided on the burning lid part that has the lower edge opening part, and the roof is integrally provided in the inner side of the cylinder handle; and (6) a silver clay sintering apparatus wherein the burning cylinder and the burning lid part described in the above (4) and (5) can each be segmented into a plurality of parts.

In this case, it is preferable that the cross-section of the burning cylinder with a bottom and the sintering lid part is circular, and the burning cylinder with a bottom is a circular cylinder with a bottom, however, the cross-sectional shape of the burning cylinder with a bottom is not limited thereby, and elliptical shapes and polygonal shapes are also possible.

According to the silver clay sintering method and apparatus for the same of the present invention, because the worker can assemble the sintering apparatus individually, it is possible to fabricate precious metal decorations by readily and simply sintering a small number of silver clay compositions, and it is convenient because the silver clay sintering apparatus can be easily stored after the sintering is complete.

DETAILED DESCRIPTION OF THE PREFERRED EMBODIMENT

Next, the apparatus of the present invention that implements the sintering method for silver clay will be concretely explained with reference to the figures.

Figure 1:
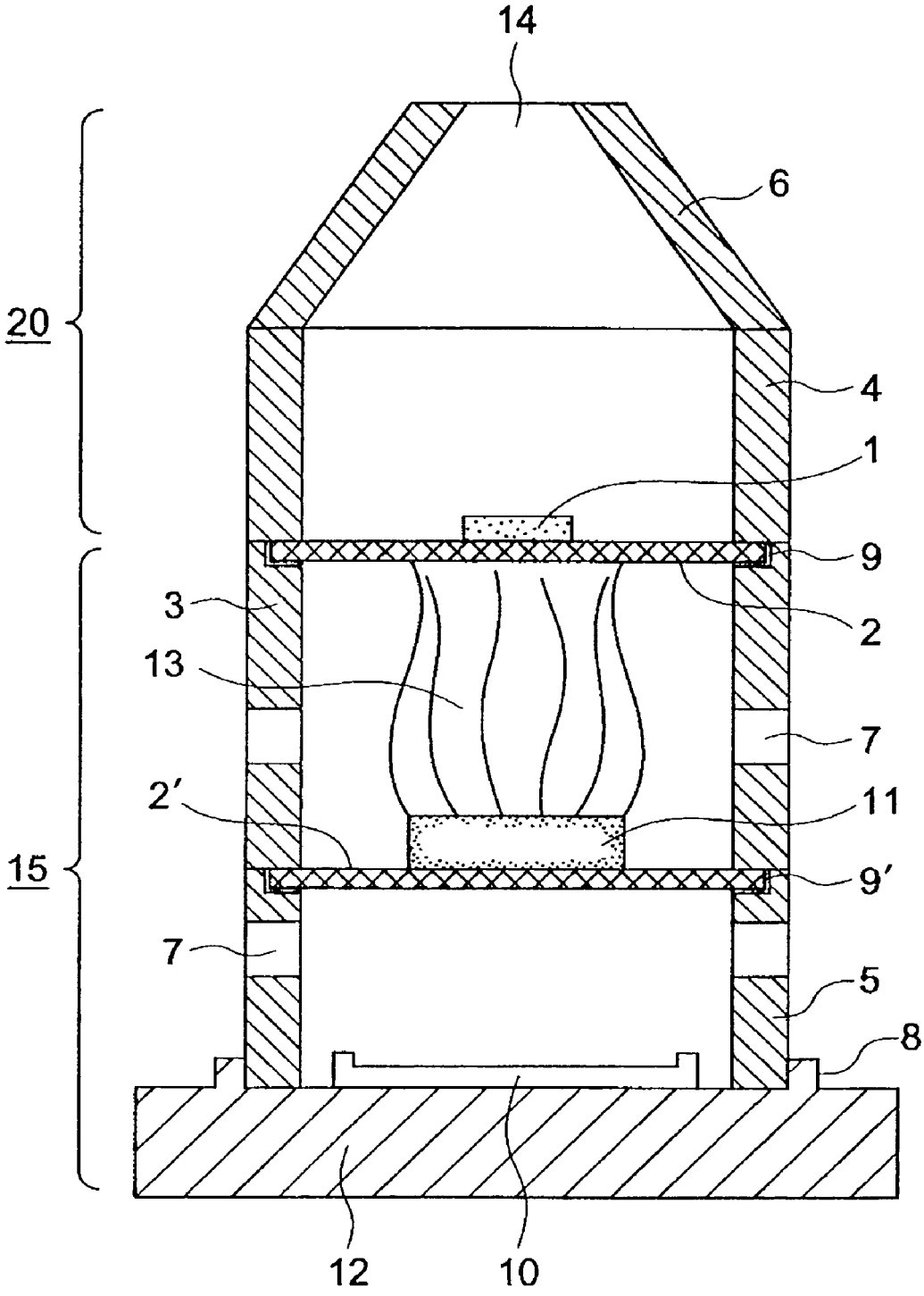
FIG. 1 is a cross-sectional diagram showing an example of the silver clay sintering apparatus.

FIG. 1 is a cross-sectional diagram showing an example of the silver clay sintering apparatus of the present invention. This silver clay sintering apparatus comprises a burning cylinder with a bottom 15 that provides air holes 7 in at least the side wall and a burning lid part 20 that covers the upper end of burning cylinder with a bottom 15 and engages the upper end opening part of burning cylinder having a bottom 15. The burning cylinder having a bottom 15 can be segmented into a ring-shaped upper enclosure 3 made of an insulating fire-resistant material, a ring-shaped platform enclosure 5 made of an insulating fire-resistant material, and a platform 12, and the burning lid part 20 can be segmented into a ring-shaped lower enclosure 4 made of an insulating fire-resistant material and a cone-shaped roof 6 having an exhaust hole 14. In addition, this apparatus is made of an insulating material, and in particular, preferably the burning cylinder having a bottom 15 and the burning lid 20 are both also made of an insulating material. As an insulating material, an insulating alloy such as stainless steel can be used, however, because insulating characteristics are required, preferably mullite, alumina, magnesia, zirconia, silica, earthenware or the like are used, and mullite is most preferably from the point of view of cost.

In addition, in FIG. 1, reference numeral 1 denotes a silver clay composition and 2 and 2' denote screens. Any of the following can be used as these screens 2 and 2': screens made of a heat-resistant alloy such as stainless steel, a coating screen on which a fire-resistant material has been coated on a metal screen, or a screen with superior heat-resistant characteristics such as a ceramic screen. A recess 9 for engaging the screen 2 is provided in the upper end of the upper enclosure 3 of the burning cylinder having a bottom 15, and a recess 9' is provided for engaging the screen 2' in the upper end of the platform enclosure 5. These recesses 9 and 9' are for stabilizing the screens 2 and 2' when the screens 2 and 2' are mounted on the upper edge of the upper enclosure 3 and the platform enclosure 5, however, the sintering is possible even if the recesses 9 and 9' are not provided.

In addition, in the side wall of the upper enclosure 3 and the platform enclosure 5, at least one pair of air holes 7 are provided so as to face each other. A ring-shaped projection 8 is provided on the platform 12 to fasten the platform enclosure 5, and the platform enclosure 5 is detachably fastened to the platform 12 by engaging the ring-shaped projection 8. In addition, 10 denotes a pan for receiving the minute amount of ash generated during burning of the solid alcohol fuel 11.

To sinter the silver clay using this silver clay sintering apparatus, the silver clay sintering apparatus is assembled as follows: first, the tray 10 is placed at the center part of the platform 12, the platform enclosure 5 is fastened by being set on the ring-shaped projection 8 of the platform 12, the screen 2' is placed into the recess 9' of the upper end of the platform enclosure 5, the solid alcohol fuel 11 is placed on the screen 2', the upper enclosure 3 is mounted on the platform enclosure 5, the screen 2 is placed into the recess 9 on the upper end of the upper enclosure 3, the lower enclosure 4 is placed on the upper edge of the upper enclosure 3, and then the roof 6 is mounted on the lower enclosure 4.

After the apparatus is assembled, when the solid alcohol fuel 11 is ignited and burned, air that is supplied from the air holes 7 provided in the side wall of the platform enclosure 5 rises due to a chimney action, is rectified by passing through the screen 2', the silver clay composition 1 is evenly heated by making the direction of the flame 13 of the solid alcohol fuel 11 constant, and sintering occurs. The apparatus shown in FIG. 1 comprises the burning cylinder having a bottom 15 and the burning lid part 20, and the burning cylinder having a bottom 15 can be segmented into the ring-shaped upper enclosure 3, the ring shaped platform enclosure 5, and the platform 12, and the burning lid part 20 can be segmented into the ring-shaped lower enclosure 4 and a roof 6. Thus, a comparatively large sintering apparatus can be manufactured by adjusting the space between the silver clay composition 1 and the solid alcohol fuel 11 during assembly, and therefore, a large silver clay composition can be sintered. In addition, after sintering has completed, the silver clay sintering apparatus can be easily disassembled and can be stored in a narrow location.

Figure 3:
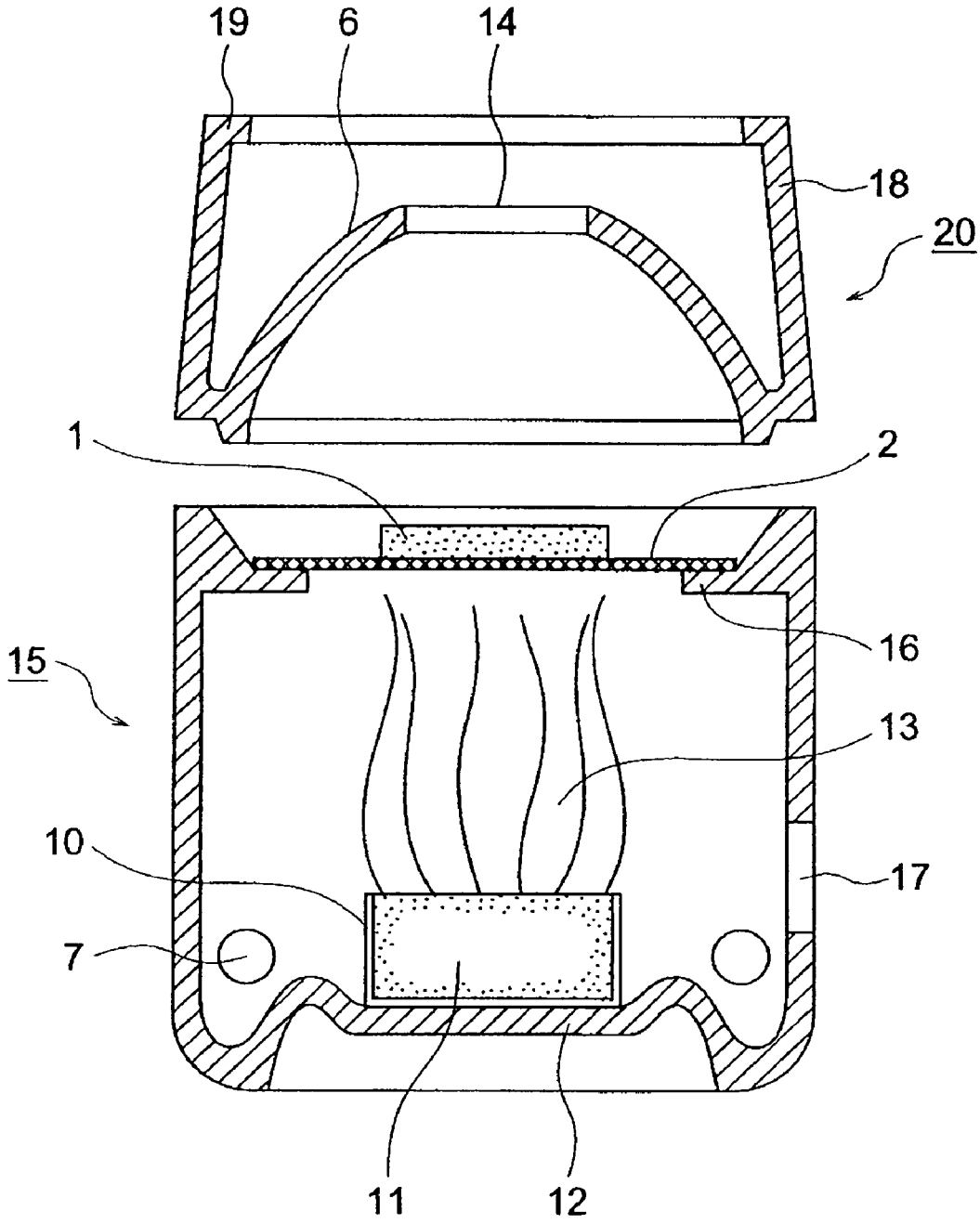
FIG. 3 is a cross-sectional diagram showing an example of the silver clay sintering apparatus of the present invention.

FIG. 3 is a cross-sectional diagram showing another silver clay sintering apparatus for implementing the sintering method for silver clay of this invention. This sintering apparatus also comprises a burning cylinder having a bottom 15 and a burning lid part 20 that covers the upper end of the burning cylinder having a bottom 15 and has a lower end opening that engages with the upper end opening part of the burning cylinder having a bottom 15.

Air holes 7 that introduce air are provided in the side wall of the burning cylinder having a bottom 15. The air holes 7 are indispensable, and an ignition hole 17 may be provided depending on necessity. The air holes 7 are preferably provided so as to be on the side of the location where the fuel is disposed. In addition, both the burning cylinder having a bottom 15 and the burning lid part 20 are preferably made of a heat-resistant material or a heat-resistant insulating material. Preferably materials identical to those of the apparatus shown in FIG. 1 can be used as the heat-resistant material or heat-resistant insulating material.

The burning cylinder having a bottom 15 and the burning lid part 20 shown in FIG. 3 are respectively integrally formed. A ledge 16 is provided on the upper end opening part of the burning cylinder having a bottom 15, and this ledge 16 supports the screen 2. The material of the screen 2 is identical to that used in the apparatus shown in FIG. 1. In addition, a solid alcohol fuel 11 that fills the pan 10 is mounted on the platform 12 of the burning cylinder having a bottom 15.

The burning lid part 20 comprises a tubular handle part 18 and a roof 6 integrally provided on the inside of the tubular handle part 18 and an exhaust hole 14 is provided in the ceiling. An edge 19 that extends towards the inside to improve the strength of the tubular handle part 18 is provided on the upper end of the tubular handle part 18. In this structure, because the tubular handle part 18 is separated from the exhaust hole 14 provided in the ceiling of the roof 6, the tubular handle part 18 does not become hot at the heat necessary to sinter a silver clay composition. Furthermore, it is preferable that the roof 6 is slanted. The air heated by the solid alcohol fuel is discharged to the outside from the exhaust hole 14, however, when the roof 6 is formed at an angle, the flow of the air speeds up here, and fresh air can be easily supplied from the ignition hole 17.

Next, the silver clay sintering method using the silver clay sintering apparatus shown in FIG. 3 will be explained. First, the pan 10 filled with the solid alcohol fuel 11 that is the heat source is placed at the platform 12 of the burning cylinder having a bottom 15. The post-processing and handling of the solid alcohol fuel 11 are easy because almost no remaining waste such as ash is generated. Furthermore, because it is possible to calculate the size of the block of the solid alcohol fuel 11 previously such that it burns and then burns out when the sintering has completed, it is not necessary to perform a stopping operation of the burning as is the case with a gas tank, an alcohol lamp, a gas burner, or the like.

Figure 4:
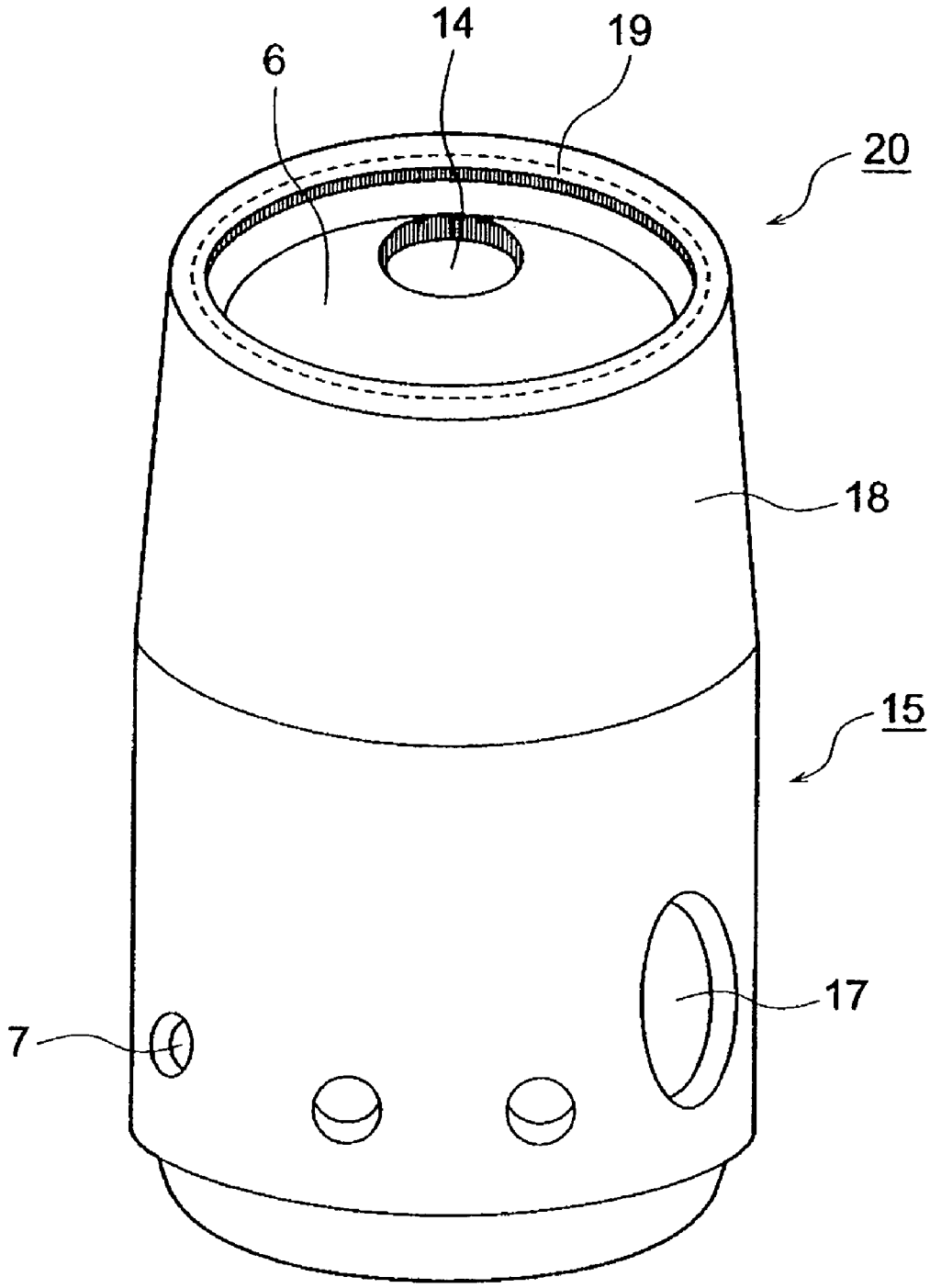
FIG. 4 is an upper perspective drawing of the silver clay sintering apparatus shown in FIG. 3.

After the solid alcohol fuel 11 is placed at the platform 12 of the burning cylinder having a bottom 15, the screen 2 is placed on the ledge 16 of the upper end opening of the burning cylinder having a bottom 15, and after placing the silver clay composition 1 on the screen 2, the burning lid part 20 having the tubular handle part 18 covers by aligning with the upper end of the burning cylinder having a bottom 15. FIG. 4 shows that upper perspective drawing of the state in which the burning lid part 20 covers the burning cylinder having a bottom 15.

Then, the solid alcohol fuel 11 is ignited from the ignition hole 17, and after the solid alcohol fuel 11 burns out an the sintering of the silver clay composition 1 has completed, the burning lid part 20 is removed, and the silver clay sintered body is taken out. After the sintering has completed, the silver clay composition can be removed by removing the burning lid part 20 after the silver clay sintering apparatus has cooled, however, in this burning lid part 20, the tubular handle 18 does not become hot even during the burning of the solid alcohol fuel 11, and thus the burning lid part 20 can be removed and the silver clay composition can be taken out immediately after the sintering is complete. Other operational effects are identical to the silver clay sintering apparatus shown in FIG. 1.

EXAMPLE 1

Below, an example will be illustrated and the effect of the present invention explained. The following were previously prepared:

- a mullite platform enclosure having an outer diameter of 110 mm, an internal diameter of 90 mm, a height of 30 mm, and having an air hole with a diameter of 10 mm in the side wall;
- a mullite lower enclosure having an external diameter of 110 mm, an inner diameter of 90 mm, a height of 60 mm;
- a mullite upper enclosure having an external diameter of 110 mm, an inner diameter 90 mm, and a height of 60 mm;
- two 12 mesh stainless steel screens;
- pan;
- 20 g of solid alcohol fuel; and
- a mullite platform.

In addition, a commercially available pure silver clay is molded and dried, and a pure silver clay composition having a diameter of 20 mm, a height of 2 mm is fabricated.

As shown in FIG. 1, the pure silver clay composition and the 20 g of solid alcohol fuel 11 are respectively placed on the screens 2 and 2' and the sintering apparatus is assembled, and igniting the solid alcohol fuel 11. As a result, the generated flame 13 surrounds the pure silver clay composition and sintering occurs. After 10 minutes, the solid alcohol fuel has burned out, the pure silver clay composition is removed, and the pure silver clay composition is sufficiently sintered.

Figure 2:
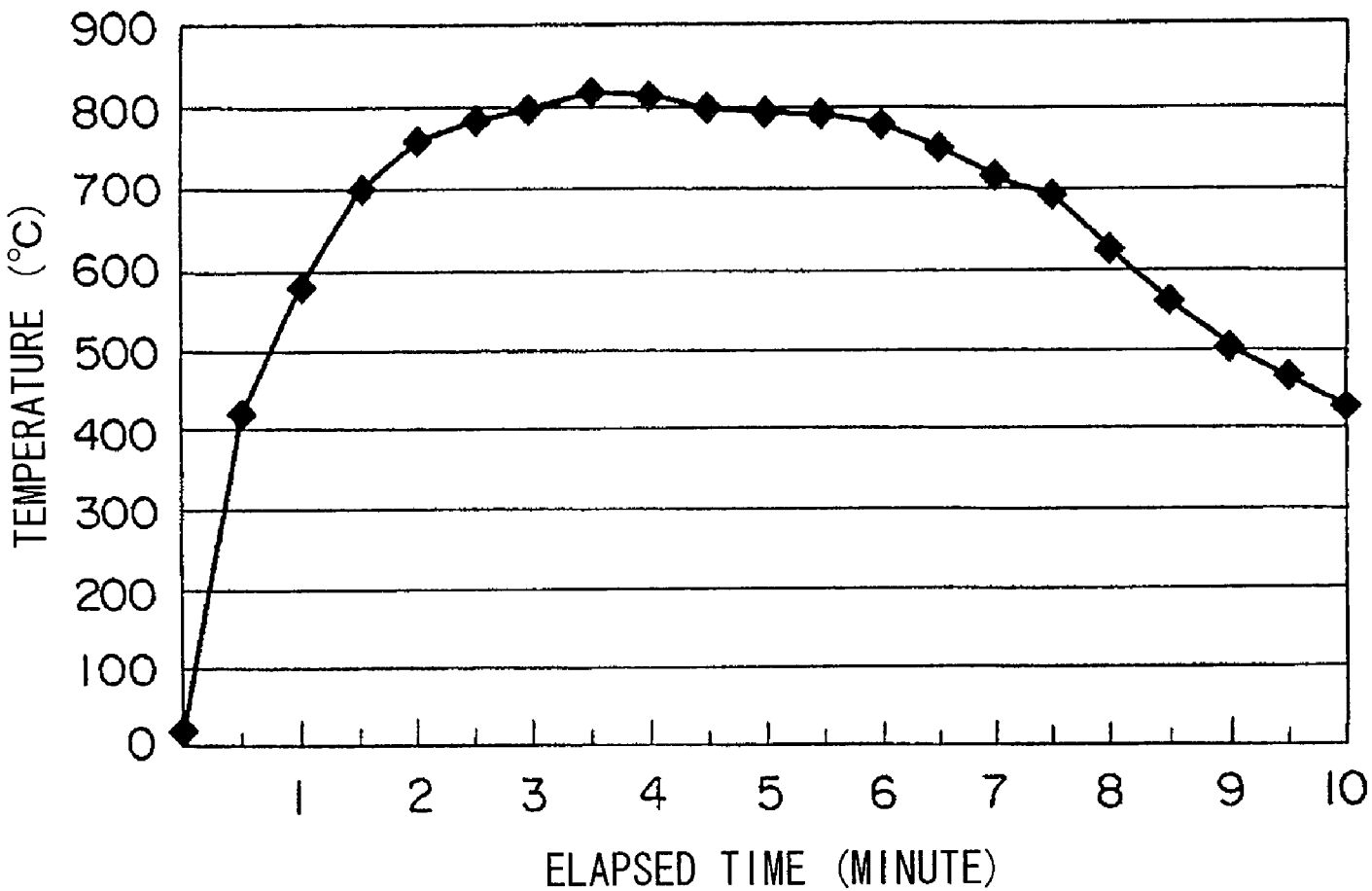
FIG. 2 is the temperature curve of the interior of the sintering apparatus obtained by burning a solid alcohol fuel.

In addition, when the temperature is measured in the vicinity of the pure silver clay composition in the sintering apparatus over the 10 minutes from the beginning to the completion of the sintering, the temperature curve shown in FIG. 2 is obtained. As is clear from FIG. 2, in this sintering method, the temperature in the sintering apparatus rises to 700° C. in 1 minute and 30 seconds, and it is confirmed that the sintering temperature is reached comparatively quickly. In addition, a temperature between 700 and 800° C. is maintained for 7 minutes, and it is confirmed that sufficient sintering is possible for the pure silver clay composition.

EXAMPLE 2

A burning cylinder having a bottom 15 and a burning lid part 20 that form the assembled silver clay sintering apparatus as shown in FIG. 3 are each fabricated from mullite. Then the pure silver clay composition 1 fabricated in example 1 is placed on the 12 mesh stainless steel screen 16 that has been placed on the upper end of the burning cylinder having a bottom 15 as shown in FIG. 3, and a block of solid alcohol fuel 11 having a diameter of 40 mm and a height of 20 mm is ignited. As a result, the generated flame 13 surrounds the pure silver composition, and sintering occurs. Next, when the solid alcohol fuel 11 has burned out, the tubular handle 18 is grasped, the burning lid part 20 is removed, the pure silver clay composition is taken out, and the pure silver clay composition is sufficiently sintered.

What is claimed is:

1. A silver clay sintering apparatus comprising a burning cylinder having a bottom in which a bottom surface thereof is closed and air holes are provided at least in a side wall thereof, and a burning lid part that has a lower end opening that engages an upper end opening of said burning cylinder and covers an upper end of said burning cylinder, wherein a screen for placing a silver clay composition can be engaged on said upper opening of said burning cylinder, said burning lid part comprises a slanted roof in a ceiling thereof, said lid has a tubular handle having an edge provided on the upper end of the tubular handle and said roof is provided integrally on an inner side of the tubular handle, and said roof has an inner shape with inner sides ending in a center area where an exhaust hole is provided wherein the burning lid part and the burning cylinder with the bottom are separable from each other and the tip end of the exhaust hole provided on the roof in the burning lid part is positioned under the under surface of the edge of the tubular handle, wherein said edge of the tubular handle forms a lip extending toward the inside of the burning lid part.

2. The silver clay sintering apparatus according to claim 1 wherein said burning cylinder can be segmented into a plurality of parts.

3. The silver clay sintering apparatus according to claim 1 wherein said burning lid part can be segmented into a plurality of parts.

4. The silver clay sintering apparatus according to claim 2 wherein said burning lid part can be segmented into a plurality of parts.

5. The silver clay sintering apparatus according to claim 1 wherein said silver clay composition which is placed on said screen is exposed to a flame of a solid alcohol fuel from below.

6. The silver clay sintering apparatus according to claim 5 wherein said silver clay composition is sintered in a state in which said silver clay composition and the solid alcohol fuel are surrounded by a wall part comprising an insulating material.

7. The silver clay sintering apparatus according to claim 1 wherein said silver clay sintering apparatus is structured such that a temperature in the vicinity of the silver clay composition inside silver clay sintering apparatus can be maintained at between 700° C. and 800° C. over a period of time sufficient to achieve sintering of the silver clay composition.

8. The silver clay sintering apparatus to claim 7 wherein the period of time is set to be about 7 minutes.

9. The silver clay sintering apparatus to claim 1, wherein said roof comprises a truncated cone shape or a hemispherical shape.

* * * * *